US006520799B1

(12) United States Patent
Cheng et al.

(10) Patent No.: US 6,520,799 B1
(45) Date of Patent: Feb. 18, 2003

(54) STACKED CONNECTOR ASSEMBLY

(75) Inventors: Cho-Yao Cheng, Taipei (TW); Danny Yin, Taipei (TW)

(73) Assignee: Tekcon Electronics Corp., Taipei Hsien (TW)

( * ) Notice: Subject to any disclaimer, the term of this patent is extended or adjusted under 35 U.S.C. 154(b) by 0 days.

(21) Appl. No.: 09/964,084

(22) Filed: Sep. 26, 2001

(30) Foreign Application Priority Data

Sep. 20, 2001 (TW) ..... 090216052

(51) Int. Cl.[7] ..... H01R 13/73
(52) U.S. Cl. ..... 439/541.5; 439/607
(58) Field of Search ..... 439/541.5, 490, 439/489, 676, 79, 607, 609, 701

(56) References Cited

U.S. PATENT DOCUMENTS 6,033,258 A * 3/2000 Huang et al. ..... 439/541.5
6,099,349 A * 8/2000 Boutros ..... 439/541.5
6,113,422 A * 9/2000 Somerville et al. ..... 439/490
6,159,039 A * 12/2000 Wu ..... 439/541.5
6,162,089 A * 12/2000 Costello et al. ..... 439/541.5
6,174,198 B1 * 1/2001 Wu et al. ..... 439/541.5
6,183,292 B1 * 2/2001 Chen et al. ..... 439/541.5
6,283,786 B1 * 9/2001 Margulis et al. ..... 439/490
6,352,446 B2 * 3/2002 Ezawa et al. ..... 439/490
6,368,151 B1 * 4/2002 Chen et al. ..... 439/541.5

* cited by examiner

*Primary Examiner*—Gary Paumen

(57) ABSTRACT

A stacked connector assembly includes a first connector device and a second connector device stacked on the first connector device. The first connector device includes an insulative housing retaining first conductive contacts therein. The second connector device includes a second insulative housing retaining second conductive contacts therein. An inner shielding member encompasses the first connector device and is partially sandwiched between the first and second housings. The first housing has a top face in which two slots are defined. The slots are spaced from each other a predetermined distance and each has an side wall opposite to each other. The second housing has a bottom face positioned on the top face of the first housing with the inner shielding member partially sandwiched therebetween. Two sets of retention projections are formed on the bottom face of the second housing for extending through holes defined in the inner shielding and frictionally engaging the side walls of the slots, forming interferential engagement therebetween for retaining the housings together. Light beam guiding strips are mounted to a top face of the second housing for guiding and projecting light beam emitting from light emitting diodes mounted to a rear face of the second housing. An outer shielding member encompasses both the first and second connector devices.

17 Claims, 4 Drawing Sheets

STACKED CONNECTOR ASSEMBLY

BACKGROUND OF THE INVENTION

1. Field of the Invention

The present invention relates generally to a stacked connector assembly, and in particular to a stacked connector assembly having components with simplified structure.

2. Related Arts

Electrical connectors are widely used in a variety of electronic or electrical devices for providing electrical connection between separate electrical components. The current trend of miniaturization of electrical/electronic appliances requires the footprints of the electrical connectors on a printed circuit board (PCB) to be minimized. A solution to the minimization of footprint is to stack a number of connectors in an upright pile. An example is disclosed in U.S. Pat. No. 6,162,089 wherein a "Modular Jack" type connector is stacked over two "USB (Universal Serial Bus)" type connectors. A common housing to both the Modular Jack and the USB connectors is formed and cavities are defined in the common housing for receiving and retaining contacts of the Modular Jack and USB connectors. A disadvantage associated with the common housing configuration is that the structure and manufacture of the housing is inevitably sophisticated.

Furthermore, since the housing is common to both Modular Jack and USB connectors, the housing must be entirely disposed even only one of the Modular Jack and the USB connectors is damaged. This inevitably increases the manufacturing costs.

In addition, high frequency transmission requires EMI shielding be formed between Modular Jack and USB connectors in order to enhance quality of transmission.

It is thus desired to have a stacked connector assembly having separate housings for overcoming the above problems.

SUMMARY OF THE INVENTION

Thus, it is a primary object of the present invention to provide a stacked connector assembly comprising two connector devices having separate housings for simplifying the manufacture thereof.

Another object of the present invention is to provide a stacked connector assembly comprising two connector devices having individual housings for enhancing manufacturing process and lowering down costs.

A further object of the present invention is to provide a stacked connector assembly comprising two connector devices electromagnetically shielded with respect to each other in order to reduce electromagnetic interference therebetween.

To achieve the above objects, in accordance with the present invention, there is provided a stacked connector assembly comprising a first connector device and a second connector device stacked on the first connector device. The first connector device comprises an insulative housing retaining first conductive contacts therein. The second connector device comprises a second insulative housing retaining second conductive contacts therein. An inner shielding member encompasses the first connector device and is partially sandwiched between the first and second housings. The first housing has a top face in which two slots are defined. The slots are spaced from each other a predetermined distance and each has a side wall opposite to each other. The second housing has a bottom face positioned on the top face of the first housing with the inner shielding member partially sandwiched therebetween. Two sets of retention projections are formed on the bottom face of the second housing for extending through holes defined in the inner shielding member and frictionally engaging the side walls of the slots of the first housing, forming interferential engagement therebetween to retain the housings together. Light beam guiding strips are mounted to a top face of the second housing for guiding and projecting light beam emitting from light emitting diodes mounted to a rear face of the second housing. An outer shielding member encompasses both the first and second connector devices.

The above and other objects and advantages of the present invention can be better understood by reading the following detailed description of a preferred embodiment thereof with reference to the accompanying drawings, wherein:

DETAILED DESCRIPTION OF PREFERRED EMBODIMENT OF THE INVENTION

Figure 1:
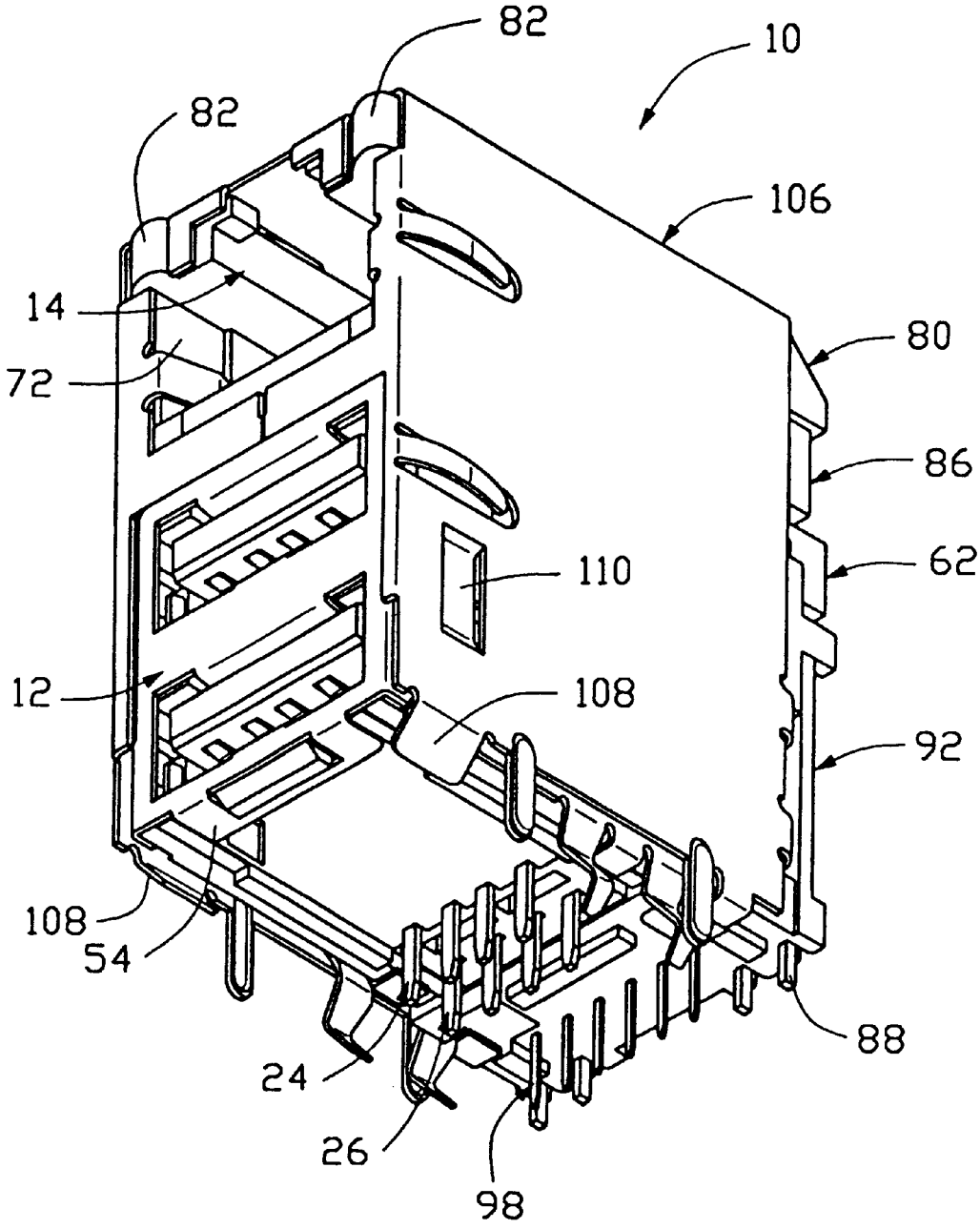
FIG. 1 is a perspective view of a stacked connector assembly in accordance with the present invention.
Figure 2:
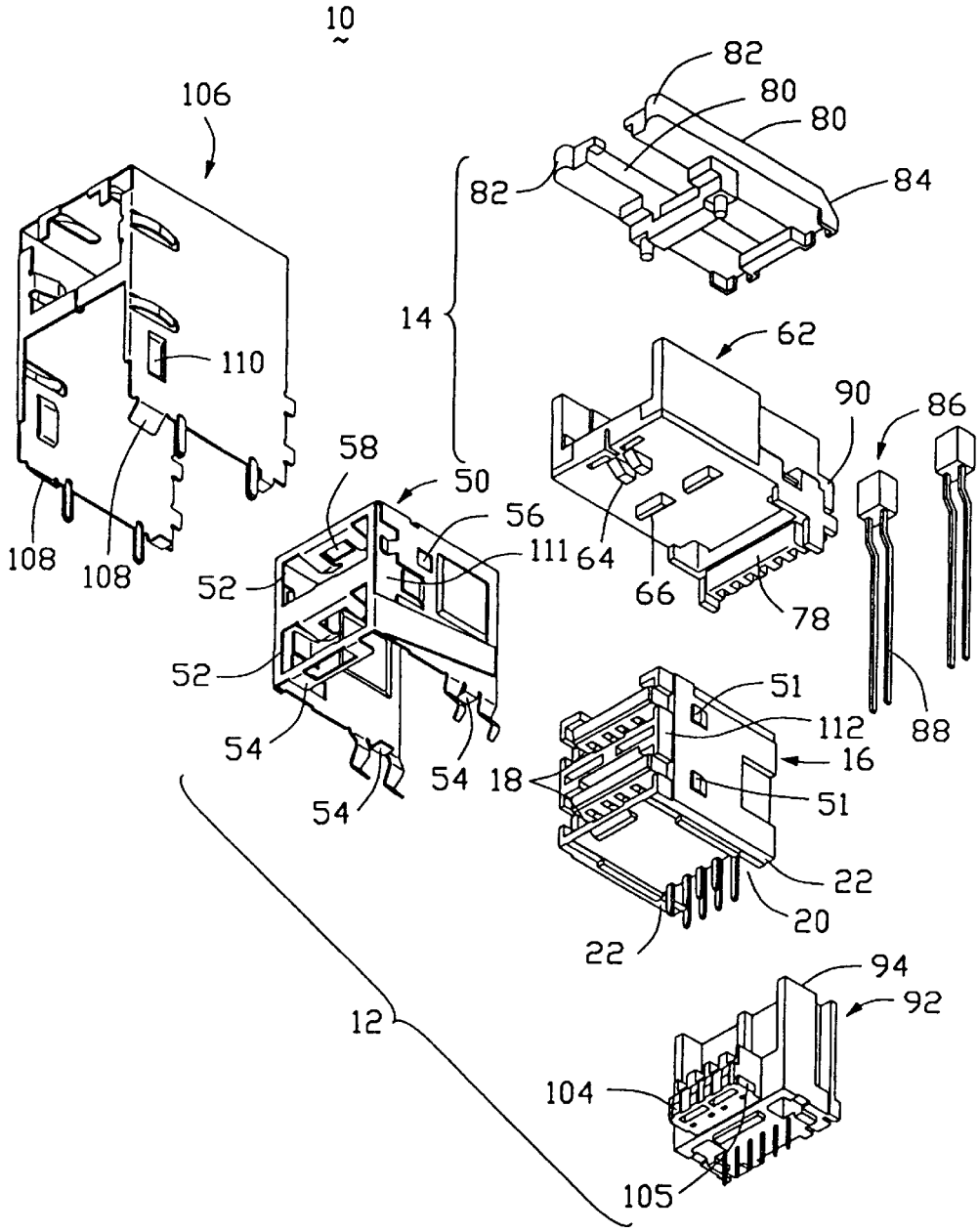
FIG. 2 is an exploded view of the stacked connector assembly of the present invention.

With reference to the drawings and in particular to FIGS. 1 and 2, a stacked connector assembly constructed in accordance with the present invention, generally designated with reference numeral 10, comprises a first connector device 12 and a second connector device 14 stacked over the first connector device 12. In the embodiment illustrated, the first connector device 12 comprises two USB (Universal Serial Bus) type connectors, while the second connector device 14 comprises an RJ modular jack type connector. However, it is noted that the present invention can be applied to connectors other than these types.

Figure 4:
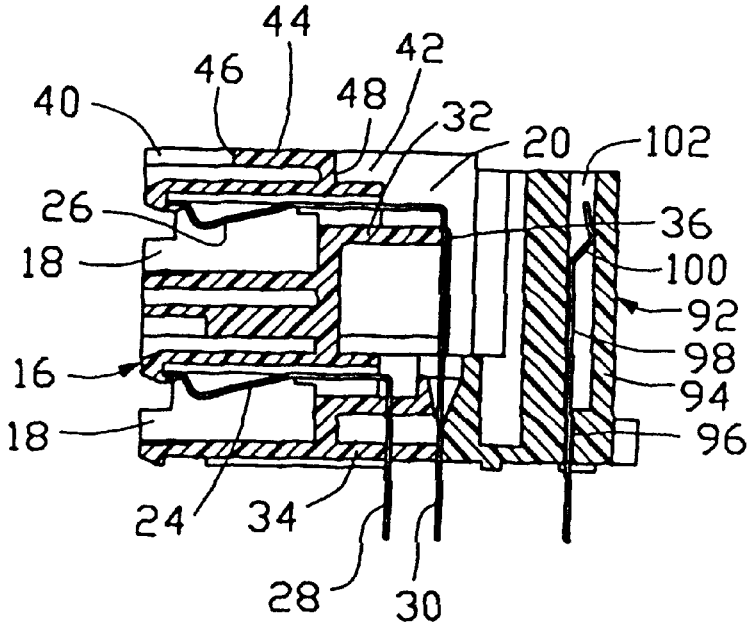
FIG. 4 is a cross-sectional view of a first connector device of the stacked connector assembly.

Further referring to FIG. 4, the first connector device 12 comprises a first insulation housing 16 which is substantially parallelepiped in the embodiment illustrated, having top, bottom, front, rear, left side and right side faces. Two cavities 18 are defined in the front face of the first housing 16 arranged in a vertical stack fashion for receiving and retaining a plurality of conductive contacts 24, 26 therein, thus forming two USB connectors. A pair of opposite walls 22 is formed on the rear face of the first housing 16, defining a recess 20. The contacts 24, 26 have tails 28, 30 extending beyond the rear face of the first housing 16 and into the recess 20. The tails 28, 30 further extend beyond the bottom face of the first housing 16 for engaging with a printed circuit board (not shown). Contact spacing structures 32, 34 are formed in the recess 20 and each defines a plurality of grooves 36 for receiving and retaining the tails 28, 30. This is known to those having ordinary skills in the arts and thus no further details are needed herein.

Two slots 40, 42 are defined in the top face of the first housing 12 forming a land 44 therebetween. The land 44 forms a wall 46, 48 with respect to each slot 40, 42.

Preferably the walls 46, 48 extend in a direction substantially normal to the top face of the first housing 16. The slots 40, 42 are spaced from each other a predetermined distance which corresponds to width of the land 44.

In the embodiment illustrated, the first connector device 12 is surrounded by an inner shielding member 50 made of a sheet of conductive material. The inner shielding member 50 has a top panel, left side panel, right side pane and front panel respectively covering the top face, left side face, right side face and the front face of the first housing 16. The front panel of the inner shielding member 50 defines two openings 52 corresponding to the cavities 18 of the first housing 16. Projecting tabs 54 are formed along a bottom edge of the inner shielding member 50 and extend inwards for engaging the bottom face of the first housing 16 thereby securing the inner shielding member 50 to the first housing 16. Furthermore, at least a sideways raised portion 51 is formed on each of the left and right side faces of the first housing 16 for engaging openings 56 defined in the left and right side panels of the inner shielding member 50 to more securely attach the inner shielding member 50 to the first housing 16.

Two openings 58 (only one visible in FIG. 2) are defined in the top panel of the inner shielding member 50 in correspondence to the slots 40, 42 of the first housing 16.

The second connector device 14 comprises a second housing 62 made of insulative materials and having a substantially parallelepiped configuration having front, rear, bottom, top, left side and right side faces. The second connector device 14 is stacked on the first connector device 12 by positioning the bottom face of the second connector device 14 on the top face of the first connector device 12 with the top panel of the inner shielding member 50 sandwiched therebetween.

Two sets of retention projections 64, 66 are formed on the bottom face of the second housing 62, each forming a side surface 68, 70. The surfaces 68, 70 are spaced from each other a distance slightly smaller than the width of the land 44. The retentions projections 64, 66 are received in the slots 40, 42 by extending through the openings 58 of the inner shielding member 50. Due to the smaller distance between the side surfaces 68, 70, an interferential engagement is formed between each side surface 68, 70 and the corresponding wall 46, 48 of the land 44 thereby effectively retaining the second connector device 14 on the first connector device 12. In this respect, preferably, the side surfaces 68, 70 are substantially perpendicular to the bottom face of the second housing 62.

In the embodiment illustrated, each set of retention projections 64, 66 comprises two spaced segments for more effectively and securely attaching the second connector device 14 to the first connector device 12. It is apparent to those having ordinary skills to increase the number of the segments of each retention projection 64, 66.

A cavity 72 is defined in the front face of the second housing 62 and receives and retains a plurality of conductive contacts 74 therein. Each contact 74 has a tail 76 extending beyond the bottom face of the second housing 62 for engaging with the printed circuit board. In the embodiment illustrated, a support 78 is formed on the bottom face of the second housing 62 and defines a plurality of grooves (not labeled) for receiving and retaining the tails 76 of the contacts 74.

A pair of light beam guiders 80 in the form of elongate strips is disposed on the top face of the second housing 62, extending from the rear face of the second housing 62 to the front face. The guiders 80 are made of light transmitting material and each has a front end located in proximity of the front face of the second housing 62 and forming a beam output port 82 and a rear end located in proximity of the rear face of the second housing 62 forming a reflection surface 84 which in the embodiment illustrated is an inclined surface of a predetermined angle, such as 45 degrees.

Figure 3:
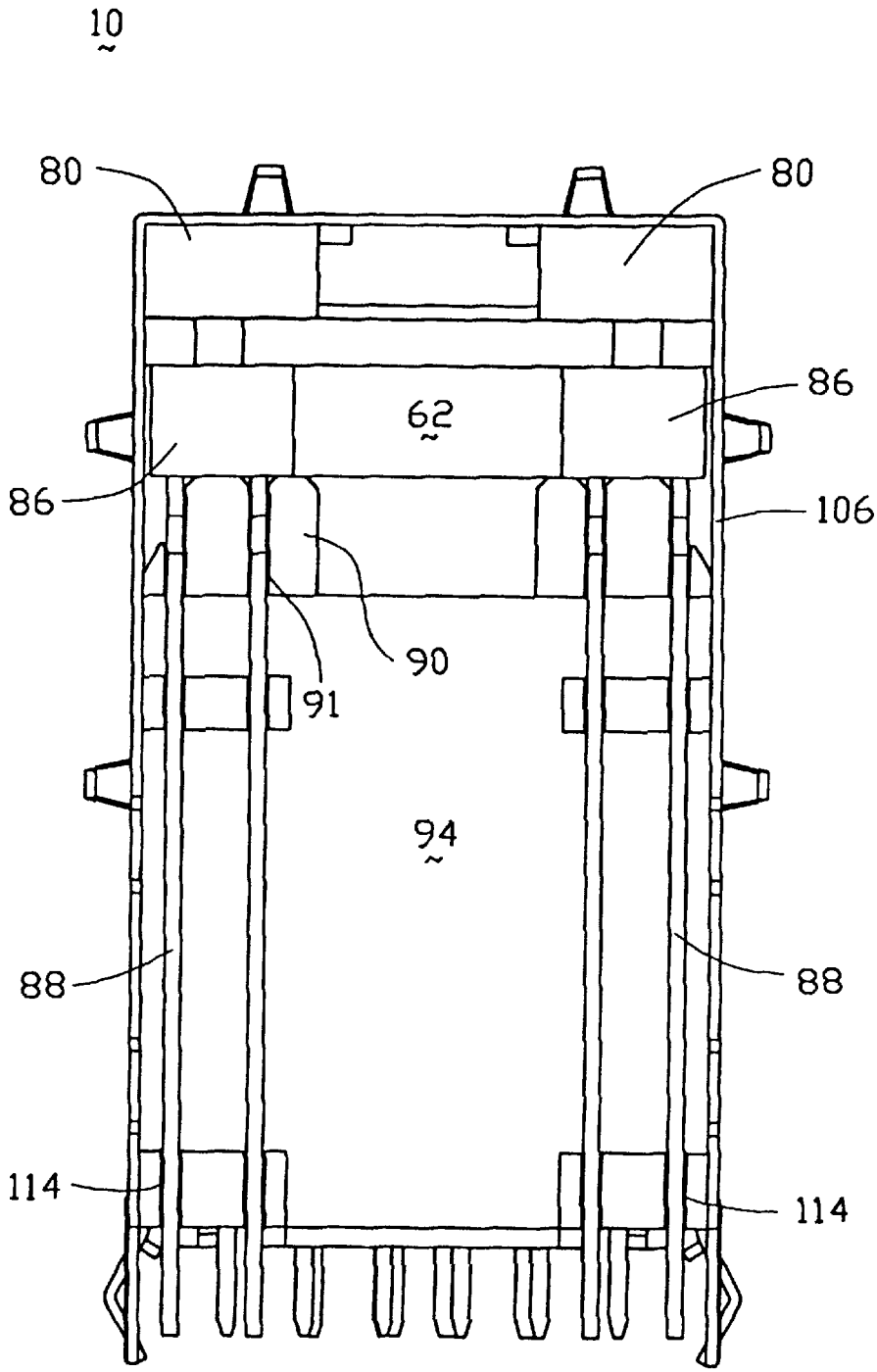
FIG. 3 is a rear view of the stacked connector assembly of the present invention.
Figure 5:
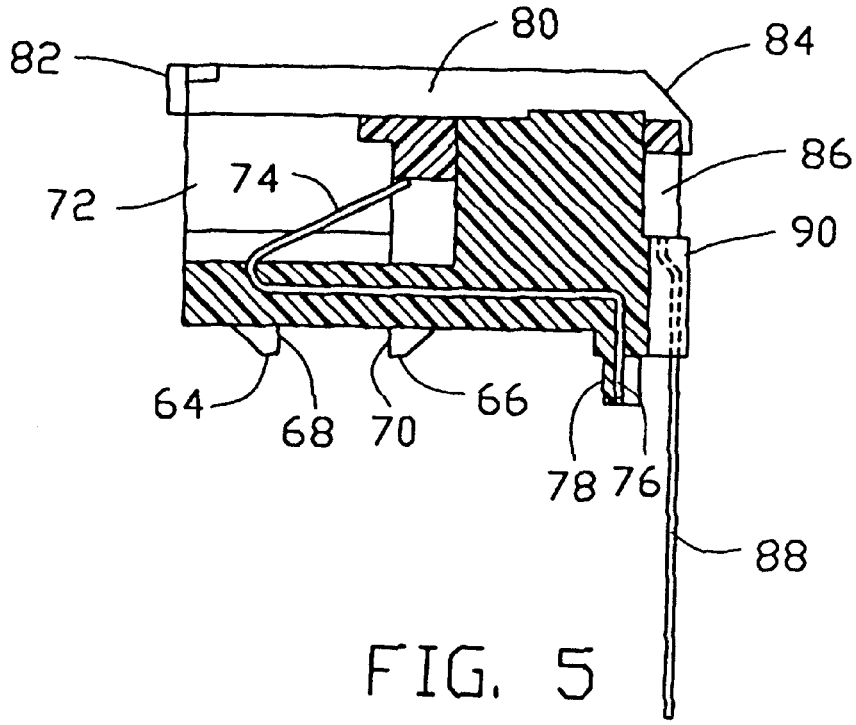
FIG. 5 is a cross-sectional view of a second connector device of the stacked connector assembly of the present invention.

The second connector device 14 comprises two light sources 86, such as light emitting diodes (LEDs), each having two leads 88 extending beyond the bottom face of the first housing 16 for engaging with the printed circuit board. Two retaining members 90 are formed on the rear face of the second housing 62, each defining two grooves 91 (FIG. 3) for receiving and retaining the leads 88 thereby securing the light sources 86 on the rear face of the second housing 62 substantially in alignment with the rear ends of the light bea guiders 80 whereby light beams emitting from the light sources 86 run incident onto the reflection surfaces 84 of the guiders 80 and are reflected thereby and guided by the guiders 80 toward the front beam output ports 82. Thus, light is projected from the ports 82.

To effectively and electrically connect the contacts 74 of the second connector device 14 to the printed circuit board, an additional spacer 92 is provided, comprising a third insulative housing 94 defining a plurality of bores 96 for receiving and retaining conductive strips 98 therein. Each strip 98 has a first end extending beyond the bottom face of the first housing 16 to be directly connected to the printed circuit board and a second end forming an engaging section 100. A slot 102 is defined in the third housing 94 in communication with the bores 96 with the engaging sections 100 located in the slot 102. The slot 102 is positioned and dimensioned to interferentially receive the support 78 of the second housing 62 therein with the tails 76 of the contacts 74 of the second connector device 14 forming physical engagement with the corresponding engaging sections 100 of the conductive strips 98. The contacts 74 of the second connector device 14 are thus effectively connected to the printed circuit board.

A sideways extension 104 is formed on a front face of the third housing 94 and is received in the recess 20 between the side walls 22. Two bosses 105 are formed on opposite sides of the extension 104 for engaging dimples (not labeled) defined in the corresponding side walls 22 to attach the third housing 94 to the first housing 16. In required, guiding ribs (not shown) may be formed on the extension 104 for movably engaging guiding slots (not labeled) defined in the side walls 22 for enhancing attachment of the third housing 94 to the first housing 16.

An outer shielding member 106 made of a sheet of conductive material and having top, front, left side and right side panels, encloses the first connector device 12, the second connector device 14 and the additional spacer 92. The outer shielding member 106 comprises projecting tabs 108 extending from a bottom edge thereof for engaging the bottom face of the first housing 16 to attach the outer shielding member 106 to the stacked connector assembly 10. Inwardly projecting portions 110 are formed on the left and right side panels of outer shielding member 106 for engaging with recessed portions 112 formed on the left and right side faces of the first housing 16 by extending through corresponding openings 111 defined in the inner shielding member 50 thereby more securely attaching the outer shielding member 106 to the stacked connector assembly 10.

At least a groove 114 is defined in the third housing 94 of the additional spacer 92 for receiving and retaining leads 88 of the light sources 86 thereby more securely retaining the light sources 86.

The present invention provides a stacked connection device comprising first and second connector devices 12, 14 having individual housings. The housings are then releasably attached to each other. This allows manufacturers of the stacked connector not to make a common housing having a sophisticated structure. In addition, the inner shielding member 50 disposed between the first and second connector devices 12, 14 effectively prevents the connectors 12, 14 from electromagnetically interfering with each other. This is of particular importance in high frequency transmission applications.

Although the present invention has been described and illustrated with the preferred embodiment thereof, it is understood to those having ordinary skills in the arts that variation and modification can be achieved without departing from the spirit and scope of the present invention which is defined by the appended claims.

What is claimed is:

1. A stacked connector assembly comprising a first connector device comprising a first insulative housing and an inner shielding member made of a conductive material and a second connector device comprising a second insulative housing, the second housing being disposed on the first housing, a portion of the inner shielding member being interposed between the first and second housings, the second housing having a bottom face forming two sets of retention projections spaced from and opposite to each other, each set comprising at least a projection having a surface whereby the surfaces are opposite to each other, wherein the surfaces interferentially engage with corresponding portions of the first housing to mount the second housing to the first housing.

2. The stacked connector assembly as claimed in claim 1, wherein the first housing has a top face on which the bottom face of the second housing is positioned, two slots being defined in the top face of the first housing corresponding to and receiving the two sets of the retention projections therein, each slot having a wall forming an interferential engagement with the surface of the corresponding retention projection.

3. The stacked connector assembly as claimed in claim 1, wherein each set comprises two projections spaced from each other.

4. The stacked connector assembly as claimed in claim 1, wherein the first housing defines two cavities arranged in a vertical stack fashion, each retaining a plurality of conductive contacts forming a USB connector.

5. The stacked connector assembly as claimed in claim 1, wherein the second housing defines a cavity retaining conductive contacts therein forming an RJ modular jack type connector.

6. The stacked connector assembly as claimed in claim 1, wherein the second connector device comprises at least a light beam guider made of light transmitting materials and positioned on a top face of the second housing, the guider comprising an elongate strip extending from a rear face to a front face of the second housing, the strip having a front end forming a light output port in proximity of the front face of the second housing and a rear end forming a reflection surface in proximity of the rear face of the second housing, a light source mounted to the second housing substantially in alignment with the reflection surface of the strip for projecting light beam onto the reflection surface from which the light beam is reflected and guided to the output port.

7. The stacked connector assembly as claimed in claim 6, wherein the second connector device comprises two light beam guiders and two light sources corresponding to the light beam guiders.

8. The stacked connector assembly as claimed in claim 6, wherein the light source comprises a light emitting diode.

9. The stacked connector assembly as claimed in claim 1, wherein the first housing forms a sideways raised portion on each of two opposite side faces, the raised portion engaging with an opening defined in the inner shielding member for attaching the inner shielding member to the first housing.

10. The stacked connector assembly as claimed in claim 1 further comprising an outer metal shielding member enclosing the first connector device and the second connector device and the inner shielding member.

11. The stacked connector assembly as claimed in claim 1 further comprising an outer metal shielding member enclosing the first connector device and the second connector device and the inner shielding member, inward projections being formed on opposite side panels of the outer shielding member, extending through openings defined in the inner shielding member and engaging with recessed portions defined in the first housing for securing the outer shielding member.

12. The stacked connector assembly as claimed in claim 1, wherein the second connector device comprises a plurality of conductive contacts retained in the second housing, each contact having a tail extending outside the second housing, an additional spacer comprising a third insulative housing retaining a plurality of conductive strips therein, the third housing being attached to the first housing whereby the conductive strips physically engage the corresponding tails of the contacts of the second connector device and form electrical connection therebetween.

13. The stacked connector assembly as claimed in claim 12, wherein the second housing forms a support carrying and supporting the tails of the contacts of the second connector device, the third housing defining a slot with an engaging portion of each conductive strip of the additional spacer located in the slot, the support of the second housing being interferentially received in the slot of the third housing for attaching the additional spacer to the second housing and to electrically connect the engaging portions of the conductive strips to the tails of the contacts of the second connector device.

14. The stacked connector assembly as claimed in claim 6, wherein the light source comprises at least one lead, a groove being defined in the first housing for receiving and retaining the lead.

15. The stacked connector assembly as claimed in claim 14, wherein the light source comprises two leads, the first housing defining two grooves for receiving and retaining the leads respectively.

16. A stacked connector assembly comprising a first connector device comprising a first insulative housing, a second connector device comprising a second insulative housing and an outer metal shielding member enclosing the first and second connector devices, the second housing being disposed on the first housing, the second housing having a bottom face forming two sets of retention projections spaced from and opposite to each other, each set comprising at least a projection having a surface whereby the surfaces are opposite to each other, wherein the surfaces interferentially engage with corresponding portions of the first housing to mount the second housing to the first housing.

17. A stacked connector assembly comprising a first connector device comprising a first insulative housing and a second connector device comprising a second insulative housing, the second housing being disposed on the first housing, a first interengaging means arranged between the first housing and the second housing for securing the second housing on the first housing in a longitudinal direction, a second interengaging means arranged between the first housing and the second housing for securing the second housing on the first housing in a traverse direction, said first and second interengaging means comprising projections having opposite surfaces thereon, wherein the surfaces interferentially engage with corresponding portions of the first housing to mount the second housing to the first housing.

* * * * *